United States Patent [19]

Hennebutte

[11] Patent Number: 4,507,094

[45] Date of Patent: Mar. 26, 1985

[54] BOARD FOR AQUATIC SPORTS

[76] Inventor: Georges B. Hennebutte, 43, Avenue Foch, Biarritz, France, 64200

[21] Appl. No.: 406,620

[22] Filed: Aug. 9, 1982

[51] Int. Cl.[3] ..... B63B 35/72

[52] U.S. Cl. ..... 441/65; 441/79; 441/74; 114/288; 272/1 B; 46/153

[58] Field of Search ..... 114/288, 67 A; 441/65, 441/67, 74, 71; 272/1 B, 32, 33 R, 71; 273/1 L; 46/91

[56] References Cited

U.S. PATENT DOCUMENTS

| | | | |
|---|---|---|---|
| 1,104,441 | 7/1914 | Nelsen | 441/65 |
| 2,940,091 | 6/1960 | Fifer | 441/71 |
| 3,320,625 | 5/1967 | Schlueter | 441/65 |
| 3,384,910 | 5/1968 | Heston, Jr. et al. | 441/65 |
| 3,411,166 | 11/1968 | Kimmel | 441/65 |
| 4,293,968 | 10/1981 | Levine | 441/71 |

*Primary Examiner*—Trygve M. Blix
*Assistant Examiner*—Patrick W. Young
*Attorney, Agent, or Firm*—Charles B. Smith; Leonard P. Diana

[57] ABSTRACT

A board for aquatic sports is disclosed. The board, during displacement across water, directs a jet or shower of water at the abdominal region of a person lying on the board.

2 Claims, 3 Drawing Figures

BOARD FOR AQUATIC SPORTS

The invention relates to boards for aquatic sports.

Its object is to arrange such boards so as to combine to sport pleasures the improvement of the sportsman's musculature.

The invention is a board characterized in that it comprises means during the displacement of the board, to direct water jets, or showers, against a large region of the body of the sportsman lying stretched on the board.

According to a preferred embodiment of the invention, the board is formed with a oblique duct, extending obliquely through the thickness of the board, directed upwards, and arranged such that the inlet opening, located at the base, has a larger area than the outlet opening located at the upper portion.

These and other features of the invention will become more apparent from a reading of the following description, with reference to the accompanying drawings wherein.

Figure 1:
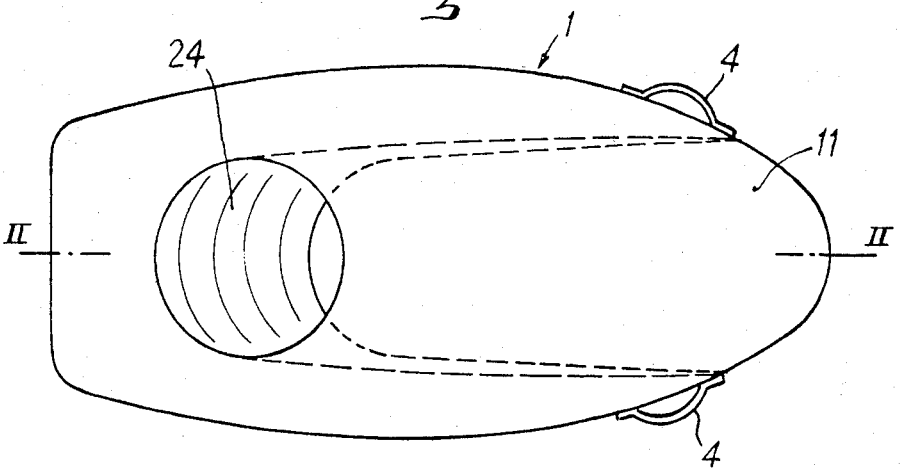
FIG. 1 is a top view of the board.
Figure 2:
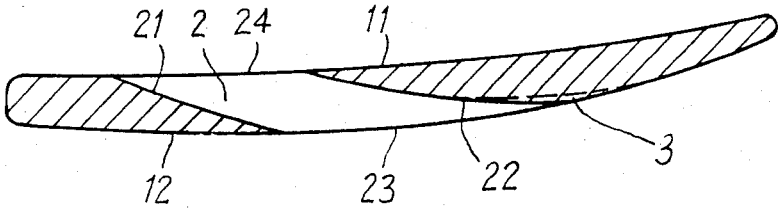
FIG. 2 is a longitudinal view taken from line II—II of FIG. 1.
Figure 3:
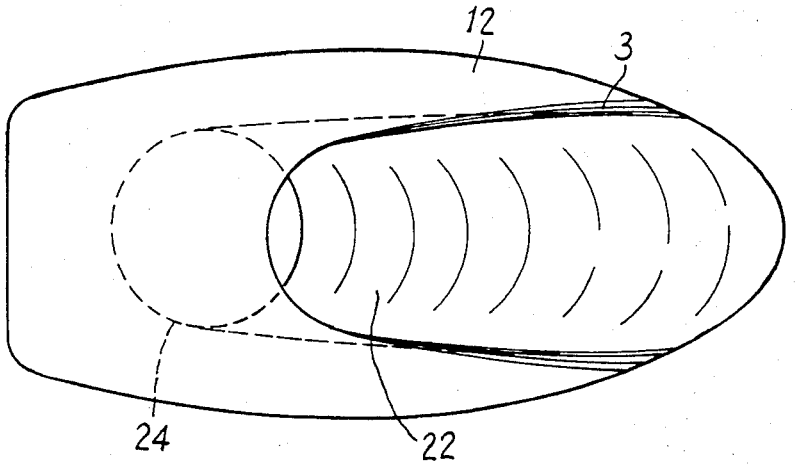
FIG. 3 is a view from below.

FIG. 1 shows generally the board, which can be manufactured, using an appropriate technique, from any material, such as plywood, a moulded plastics material, rubber, laminated polyester, or others. The board of the invention comprises the top flat portion 11, on which the user lies, and an underneath portion 12. According to the invention, the board 1 is formed with at least one duct 2 extending obliquely through the thickness of the board, inclined to the front, the duct having a forward duct surface 22 and an after duct surface 21. These surfaces are curved so as to be concave toward the front of the board, the radius of curvature of the forward duct surface being smaller than that of the after duct surface. The inlet opening on the lower surface of the board is flared at each side to form an edge 3 for canalizing water through the duct. Moreover, the board comprises means allowing the user lying on it to cling to the board, as for example, handles 4 or recesses provided to this effect in the top portion 1 of the board.

Due to the construction of the wall of duct 2, the inlet opening 23 has an area or diameter which is much larger than that of the outlet opening 24.

When moving, the user lies stretched so that his belly bears on the opening 24, while his hands are gripping the handles 4. There is a projection of liquid jets, accelerated by the speed of the board, in an area situated between the thorax and the lower part of the abdomen of the user. Such a shower provides a repeated massage effect which improves the musculature of the sportsman.

Such a board can be used not only when tugged on the water by a self-propelled dinghy or a boat, but also in the case of surfing boards pushed by the waves.

Obviously, the invention is by no way limited to the embodiment presented herein which is given by way of example only. Variations in detail and improvements can be carried out without departing from the scope of the invention, which is defined by the appended claims.

What I claim is:

1. A board for aquatic sports, comprising a board for supporting a person in water and means for directing, during displacement of the board through the water, a substantial jet of water against a substantial portion of the abdominal region of a person lying on the board, said means comprising a duct extending obliquely through the thickness of the board, the duct having a lower opening and an upper opening, the lower opening having a larger area than the upper opening, and the duct having a forward duct surface and an after duct surface, each duct surface being curved so as to be concave forward.

2. The board according to claim 1, wherein the radius of curvature of said forward duct surface is smaller than that of said after duct surface.

* * * * *